US008235490B2

(12) United States Patent
Chandu et al.

(10) Patent No.: US 8,235,490 B2
(45) Date of Patent: Aug. 7, 2012

(54) HIGH SPEED DUAL PASS INK JET PRINTER

(75) Inventors: Kartheek Chandu, Boulder, CO (US); Larry M. Ernst, Longmont, CO (US)

(73) Assignee: InfoPrint Solutions Company LLC, Boulder, CO (US)

( * ) Notice: Subject to any disclaimer, the term of this patent is extended or adjusted under 35 U.S.C. 154(b) by 776 days.

(21) Appl. No.: 12/231,578

(22) Filed: Sep. 2, 2008

(65) Prior Publication Data

US 2010/0053245 A1 Mar. 4, 2010

(51) Int. Cl.
*B41J 2/205* (2006.01)

(52) U.S. Cl. ..... 347/15; 347/41

(58) Field of Classification Search ..... 347/9, 12, 347/14, 15, 16, 40, 41, 43, 54, 101
See application file for complete search history.

(56) References Cited

U.S. PATENT DOCUMENTS

| | | | | |
|---|---|---|---|---|
| 5,640,183 | A * | 6/1997 | Hackleman | 347/40 |
| 6,206,502 | B1 * | 3/2001 | Kato et al. | 347/41 |
| 6,338,542 | B1 * | 1/2002 | Fujimori | 347/40 |
| 6,464,321 | B1 * | 10/2002 | Nunokawa | 347/19 |
| 6,652,059 | B2 * | 11/2003 | Tsutsumi | 347/15 |
| 7,118,191 | B2 * | 10/2006 | Fagan et al. | 347/41 |
| 7,198,345 | B2 | 4/2007 | Shibata et al. | |
| 7,261,388 | B2 | 8/2007 | Vega et al. | |
| 7,338,144 | B2 | 3/2008 | Mantell et al. | |
| 7,510,254 | B2 * | 3/2009 | Yun et al. | 347/15 |

FOREIGN PATENT DOCUMENTS

JP 2001018374 1/2001

* cited by examiner

*Primary Examiner* — Thinh Nguyen
(74) *Attorney, Agent, or Firm* — Blakely, Sokoloff, Taylor & Zafman LLP

(57) ABSTRACT

A method is disclosed. The method includes performing a first print pass to print a first data point on a medium using a first set of ink jet nozzles and performing a second print pass to print the first data point on the medium with a second set of ink jet nozzles.

19 Claims, 3 Drawing Sheets

HIGH SPEED DUAL PASS INK JET PRINTER

FIELD OF THE INVENTION

The invention relates to the field of printing, and in particular, to masking defects in an inkjet printer

BACKGROUND

An ink jet printer is as an example of a printing apparatus that ejects droplets of ink onto a recording medium such as a sheet of paper, for printing an image of the recording medium. The ink jet printer includes a head unit having at least one ink jet head provided with an ink cartridge that accommodates the ink. In operation of the head unit, the ink is supplied from the ink cartridge to each ink jet head having ejection nozzles, so that a printing operation is performed by ejection of the ink droplets from selected ejection nozzles.

High speed ink jet printers typically include a fixed print head unit, where only the substrate (e.g. paper) moves. However the product of such high speed, single pass ink jet printers results in various defects, such as streaks, bands, nonuniformities and white lines due to jet outs and deviated jets. Therefore, to produce high print quality either the printing speed is to be reduced or more ink is required to print. Nonetheless, some defects might persist despite such precautions being taken.

Accordingly, a mechanism to maximize print quality in high speed jet printers is desired.

SUMMARY

In one embodiment, a method is disclosed. The method includes performing a first print pass to print a first data point on a medium using a first set of ink jet nozzles and performing a second print pass to print the first data point on the medium with a second set of ink jet nozzles.

Another embodiment discloses an ink jet printing system having a print head. The print head includes first set of ink jet nozzles to perform a first print pass to print a first data point on a medium and a second set of ink jet nozzles to perform a second print pass to print the first data point on the medium.

A further embodiment discloses a network. The network includes one or more data processing systems, a print server to receive print jobs from each of the one or more data processing systems and an ink jet printer to receive the print jobs from the print server. The ink jet printer includes a first set of ink jet nozzles to perform a first print pass to print a first data point on a medium and a second set of ink jet nozzles to perform a second print pass to print the first data point on the medium

BRIEF DESCRIPTION OF THE DRAWINGS

A better understanding of the present invention can be obtained from the following detailed description in conjunction with the following drawings, in which.

DETAILED DESCRIPTION

A dual pass high speed ink jet printer is described. In the following description, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form to avoid obscuring the underlying principles of the present invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Figure 1:
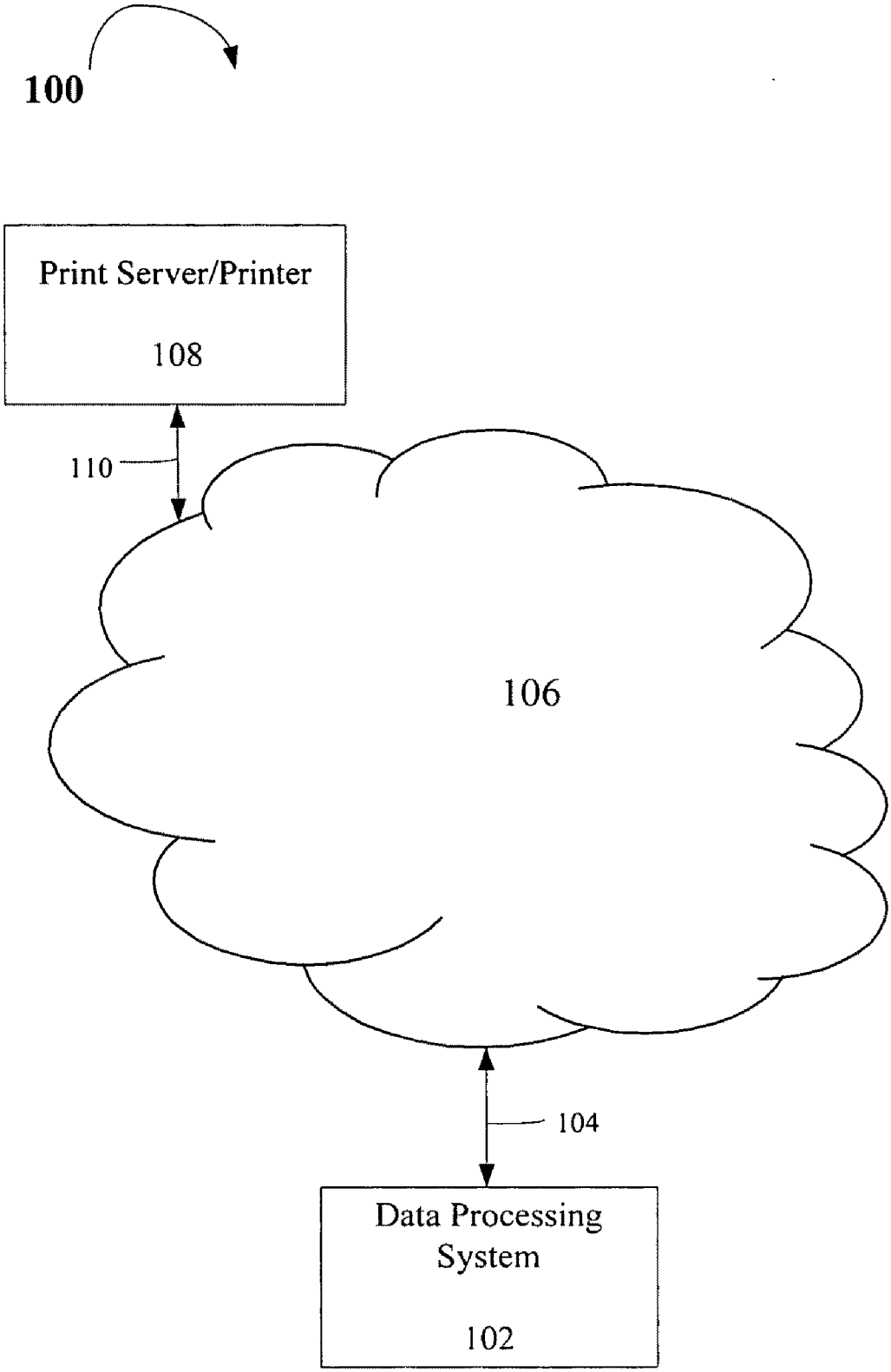
FIG. 1 illustrates one embodiment of a data processing system network.

FIG. 1 illustrates one embodiment of a data processing system network 100. Network 100 includes a data processing system 102, which may be either a desktop or a mobile data processing system, coupled via communications link 104 to network 106. In one embodiment, data processing system 102 is a conventional data processing system including a processor, local memory, nonvolatile storage, and input/output devices such as a keyboard, mouse, trackball, and the like, all in accordance with the known art. Data processing system 102 in accordance with the present invention preferably includes and employs the OS/2 operating system or a similar operating system and/or network drivers permitting data processing system 102 to communicate with network 106 for the purposes of employing resources within network 106.

Network 106 may be a local area network (LAN) or any other network over which print requests may be submitted to a remote printer or print server. Communications link 104 may be in the form of a network adapter, docking station, or the like, and supports communications between data processing system 102 and network 106 employing a network communications protocol such as Ethernet, the AS/400 Network, or the like.

According to one embodiment, network 106 includes a print server/printer 108 serving print requests over network 106 received via communications link 110 between print server/printer 108 and network 106. The operating system on data processing system 102 is capable of selecting print server/printer 108 and submitting requests for services to print server/printer 108 over network 106. Print server/printer 108 includes a print queue for print jobs requested by remote data processing systems.

The data processing system network depicted in FIG. 1 is selected for the purposes of explaining and illustrating the present invention and is not intended to imply architectural limitations. Those skilled in the art will recognize that various additional components may be utilized in conjunction with the present invention.

Figure 2:
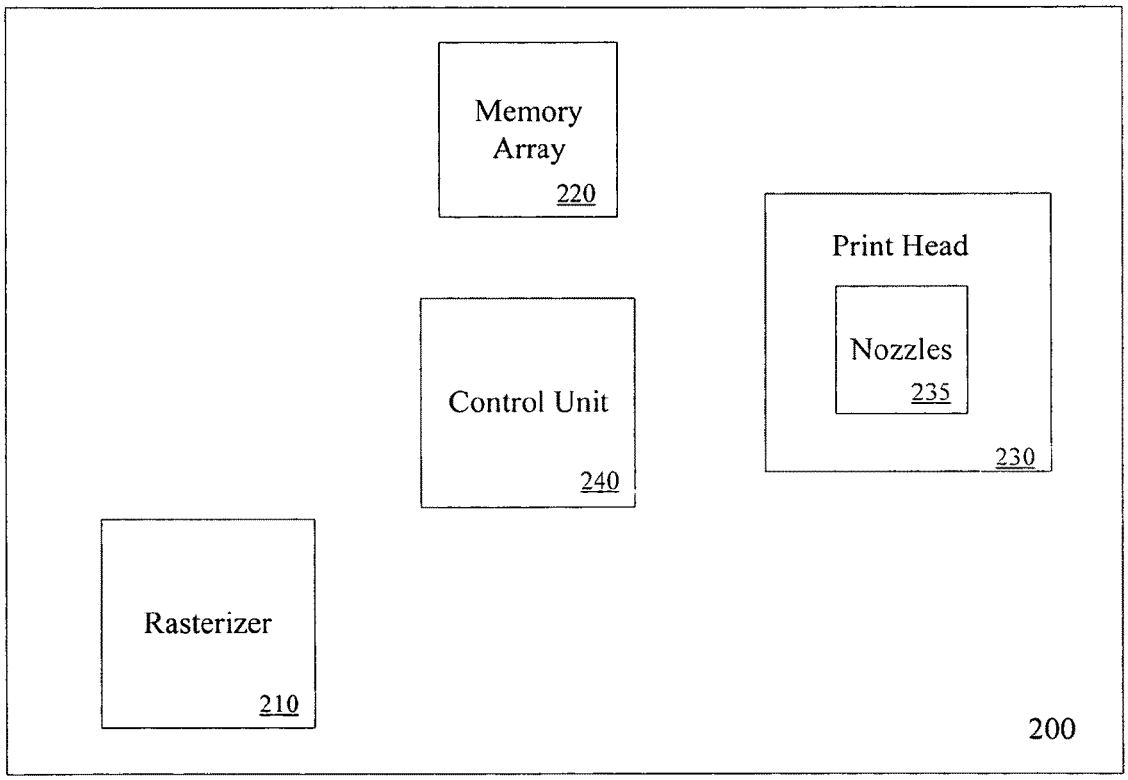
FIG. 2 illustrates one embodiment of an ink jet printer.

FIG. 2 illustrates one embodiment of an ink jet printer 200. In one embodiment, ink jet printer 200 is implemented as the printing component of print server/printer 108. Printer 200 includes a rasterizer 210, memory array 220, print head 230 and control unit 240.

Rasterizer 210 is implemented to convert vector information received at printer 200 into a raster format. Particularly, rasterizer 210 generates a raster scan of a received image that is to be stored as scan line data in memory array 220. Print head 230 includes a printing element that prints to a print medium. In one embodiment, print head 230 is an inkjet print head including nozzles 235 that are implemented to spray droplets of ink onto a sheet of paper in order to execute a print job. Control unit 240 controls the operation of print head 230.

According to one embodiment, print head 230 is a wide-array inkjet print head that employs multiple sets of nozzles 235 that are implemented to spray droplets of ink onto a sheet of paper in order to execute a print job. In a further embodiment, the multiple sets of nozzles 235 perform two print passes in order to enhance print quality.

Figure 3:
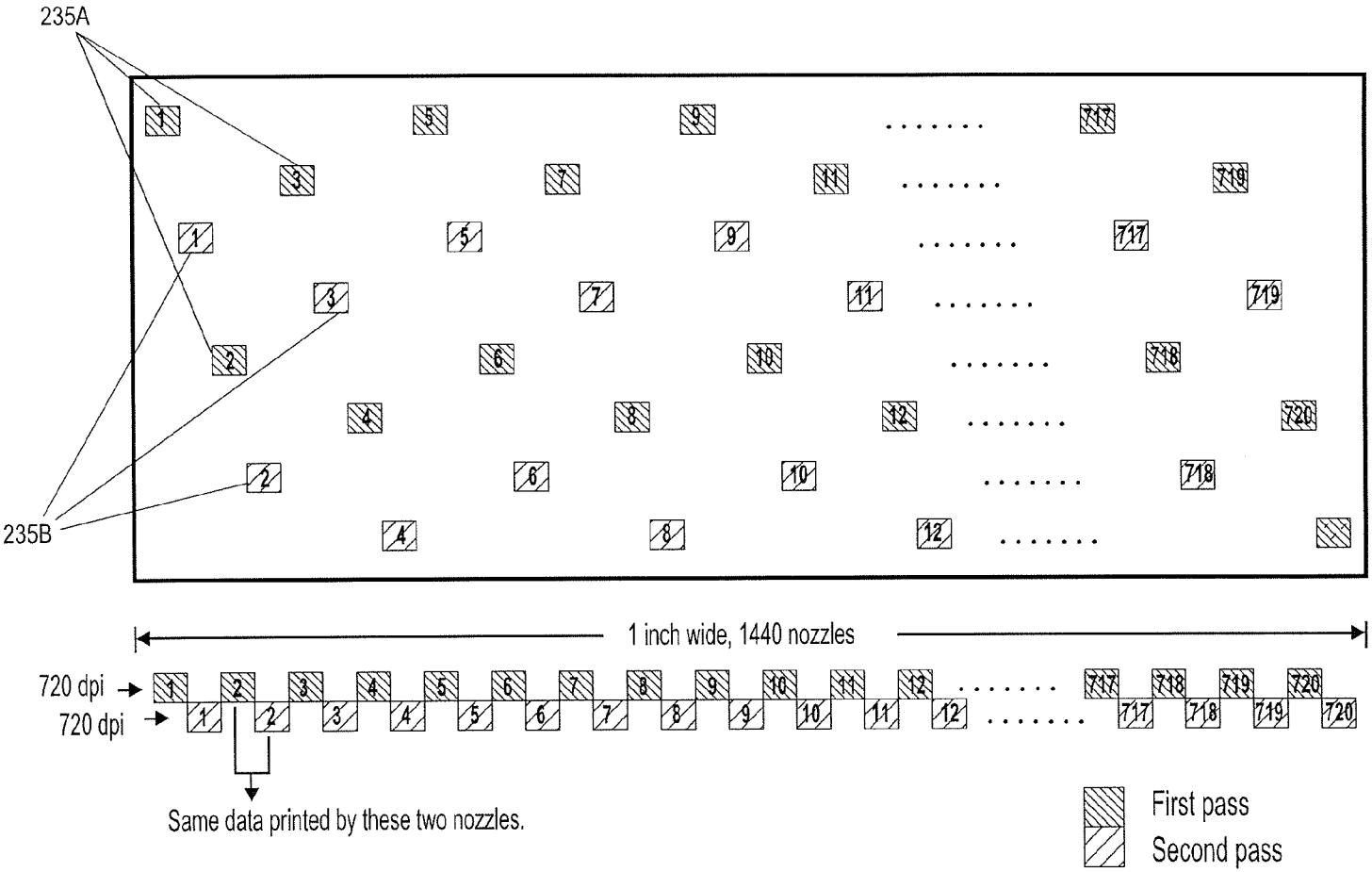
FIG. 3 illustrates one embodiment of a print head.

FIG. 3 illustrates one embodiment of print head 230 having two sets of nozzles 235A and 235B. In one embodiment, print head 230 is one inch wide with 1440 nozzles 235, with each set having 720. In a further embodiment, control unit 240 receives and converts an input file into two identical sets of rasterized data, one for each pass, which are halftoned independently. In such an embodiment, two passes use different print masks (halftones) (e.g., a rotated halftone) in the second pass for better interlacing effect and to minimize paper wetness. However in other embodiments, the passes may implement the same halftones.

According to one embodiment, every input data point will be printed twice using two different nozzles, once with a 235A nozzle and a second time with a 235B nozzle. The second set of nozzles 235B used for the second pass is shifted a half pel in scan direction with respect to the first set of nozzles 235A in order to produce an interlacing effect with fixed print head arrangement (e.g., only the substrate moves). This results in high quality throughput at higher speeds while masking print quality artifacts. Further, printing the second pass with a half pel shifted with respect to the first pass will yield higher optical densities than printing the second pass exactly top on the first pass. Thus, the two passes will have the same physical characteristics, while having no issue of misregistration.

In still a further embodiment, the two passes are controlled independently to provide different ink usage. Moreover, image intensities (or tone curve) of the two passes can be independently controlled. Independently controlled image intensities minimize the paper wetness due to sufficient drying time between the first pass and second pass. In still another embodiment, control unit 240 may be configured to switch between single pass and dual pass printing modes.

The above-described dual pass print head mechanism features a compact print head design having multiple sets of nozzles, where two independent rasterized channels received as input are printed as two separate color channels on top each other; thus enabling the same print quality as a single pass system at twice the operating speed. Further, the second pass masks all the defects that occurred during the first pass.

Embodiments of the invention may include various steps as set forth above. The steps may be embodied in machine-executable instructions. The instructions can be used to cause a general-purpose or special-purpose processor to perform certain steps. Alternatively, these steps may be performed by specific hardware components that contain hardwired logic for performing the steps, or by any combination of programmed computer components and custom hardware components.

Elements of the present invention may also be provided as a machine-readable medium for storing the machine-executable instructions. The machine-readable medium may include, but is not limited to, floppy diskettes, optical disks, CD-ROMs, and magneto-optical disks, ROMs, RAMs, EPROMs, EEPROMs, magnetic or optical cards, propagation media or other type of media/machine-readable medium suitable for storing electronic instructions. For example, the present invention may be downloaded as a computer program which may be transferred from a remote computer (e.g., a server) to a requesting computer (e.g., a client) by way of data signals embodied in a carrier wave or other propagation medium via a communication link (e.g., a modem or network connection).

Throughout the foregoing description, for the purposes of explanation, numerous specific details were set forth in order to provide a thorough understanding of the invention. It will be apparent, however, to one skilled in the art that the invention may be practiced without some of these specific details. Accordingly, the scope and spirit of the invention should be judged in terms of the claims which follow.

What is claimed is:

1. A method comprising:

performing a first print pass to print a first data point on a medium using a first set of ink jet nozzles; and performing a second print pass to print the first data point on the medium with a second set of ink jet nozzles, wherein the second set of nozzles is shifted a half pel in scan direction with respect to the first set of nozzles during printing of the first data point.

2. The method of claim 1 wherein the first print pass and the second print pass are independently controlled to provide different ink usage.

3. The method of claim 2 wherein image intensities of first print pass and the second print pass are independently controlled to minimize the medium wetness due to sufficient drying time between the first pass and the second pass.

4. The method of claim 1 wherein the first print pass and the second print have the same physical characteristics.

5. The method of claim 1 further comprising:

receiving an input file; and converting the input file to a first rasterized data for the first pass and a second rasterized data for the second pass.

6. The method of claim 5 wherein the first rasterized data and the second rasterized data are identical.

7. The method of claim 5 wherein the first rasterized data and the second rasterized data are halftoned independently.

8. The method of claim 5 wherein the first rasterized data and the second rasterized data have the same halftones.

9. An ink jet printing system comprising:

a fixed page wide array print head including:

a first set of ink jet nozzles to perform a first print pass to print a first data point on a medium; and a second set of ink jet nozzles shifted a half pel in scan direction with respect to the first set of nozzles to perform a second print pass to print the first data point on the medium during printing of the first data point.

10. The printing system of claim 9 wherein the second set of nozzles is shifted a half pel in scan direction with respect to the first set of nozzles.

11. The printing system of claim 10 wherein the first print pass and the second print pass are independently controlled to provide different ink usage.

12. The printing system of claim 11 wherein image intensities of first print pass and the second print pass are independently controlled to minimize the medium wetness due to sufficient drying time between the first pass and the second pass.

13. The printing system of claim 9 further comprising a control unit to receive an input file and convert the input file to a first rasterized data for the first pass and a second rasterized data for the second pass.

14. The printing system of claim 13 wherein the first rasterized data and the second rasterized data are identical.

15. The printing system of claim 13 wherein the first rasterized data and the second rasterized data are halftoned independently.

16. The printing system of claim 13 wherein the first rasterized data and the second rasterized data have the same halftones.

17. A network comprising:

one or more data processing systems;

a print server to receive print jobs from each of the one or more data processing systems; and a fixed page wide array ink jet printer to receive the print jobs from the print server, including:

a first set of ink jet nozzles to perform a first print pass to print a first data point on a medium; and a second set of ink jet nozzles shifted a half pel in scan direction with respect to the first set of nozzles to perform a second print pass to print the first data point on the medium during printing of the first data point.

18. The network of claim 17 wherein the second set of nozzles is shifted a half pel in scan direction with respect to the first set of nozzles.

19. The network of claim 18 wherein the ink jet printer further comprises a control unit to receive an input file an convert the input file to a first rasterized data for the first pass and a second rasterized data for the second pass.

* * * * *